US008607699B2

(12) United States Patent
Pulvino et al.

(10) Patent No.: US 8,607,699 B2
(45) Date of Patent: Dec. 17, 2013

(54) ROTATING CLICHÉ PAD PRINTER

(75) Inventors: Dana Pulvino, Crystal Lake, IL (US); Tracy Kucaba, South Elgin, IL (US); Christopher T. Schaafsma, Wheaton, IL (US)

(73) Assignee: Illinois Tool Works Inc., Glenview, IL (US)

( * ) Notice: Subject to any disclaimer, the term of this patent is extended or adjusted under 35 U.S.C. 154(b) by 485 days.

(21) Appl. No.: 12/393,738

(22) Filed: Feb. 26, 2009

(65) Prior Publication Data

US 2009/0277349 A1 Nov. 12, 2009

Related U.S. Application Data

(60) Provisional application No. 61/051,143, filed on May 7, 2008.

(51) Int. Cl.
*B41F 17/00* (2006.01)

(52) U.S. Cl.
USPC ..... 101/41; 101/42

(58) Field of Classification Search
USPC ..... 101/41–44, 169, 170, DIG. 36, DIG. 40
See application file for complete search history.

(56) References Cited

U.S. PATENT DOCUMENTS

| | | | | |
|---|---|---|---|---|
| 4,905,594 | A * | 3/1990 | Phillip et al. | 101/163 |
| 5,272,972 | A * | 12/1993 | Tobita | 101/163 |
| 5,383,398 | A | 1/1995 | Binnen | |
| 5,921,178 | A * | 7/1999 | Binnen | 101/169 |
| 6,584,894 | B1 * | 7/2003 | Mason | 101/35 |
| 6,715,416 | B1 | 4/2004 | Woloszyk | |
| 8,408,122 | B2 * | 4/2013 | Piscitello et al. | 101/41 |
| 2007/0144365 | A1 * | 6/2007 | Pulvino et al. | 101/41 |

FOREIGN PATENT DOCUMENTS

| | | |
|---|---|---|
| CN | 85108460 A | 5/1986 |
| FR | 2871100 | 12/2005 |
| FR | 2873051 | 1/2006 |

OTHER PUBLICATIONS

International Search Report for PCT/US2009/037932 dated Jul. 10, 2009.

* cited by examiner

*Primary Examiner* — Ren Yan
(74) *Attorney, Agent, or Firm* — Levenfeld Pearlstein, LLC

(57) ABSTRACT

A rotating cliché pad printer includes a frame, a flat cliché operably mounted to the frame, an ink cup configured to reside on the cliché and a pad applicator. The cliché includes at least one etched region and is adapted to receive ink thereon in the etched region. The ink cup is configured to reside on the cliché and to deposit ink into the at least one etched region. The cliché and ink cup are rotatably movable relative to one another. The pad applicator includes at least one pad adapted to move into and out of contact with the at least one etched region to receive ink from the etched region. The pad is further configured to contact an associated object to transfer the received ink to the associated object.

4 Claims, 3 Drawing Sheets

ROTATING CLICHÉ PAD PRINTER

BACKGROUND OF THE INVENTION

The present invention relates to pad printers. More particularly, the present invention relates to a rotating cliché pad printing system.

Pad printing systems are used to apply high quality print, e.g. indicia. Pad printing systems use a deformable pad which receives ink, transferred as an image, from a cliché plate. The plate has an etching or engraving of the indicia formed therein. The image is transferred from the pad to the item onto which the indicia is applied.

In typical pad printers that uses a flat cliché plate, the cliché plate has the image to be printed etched into the plate. Ink is applied to (and excess wiped from) the cliché by an ink cup. The ink cup and cliché move relative to one another to apply ink to the cliché. After the ink cup and cliché are moved laterally to expose the image, the pad is brought into contact with the inked cliché (image) to pick up the ink (ink is transferred to the pad). The pad is then brought into contact with the item to transfer the print onto the item.

In a typical configuration the relative movement of the cliché and the ink cup is a straight-line vertical motion. This has served the industry well, however, there is known to be sloshing of ink in the ink cup, and the speed at which the ink cup moves is limited by the desire to maintain sloshing at a minimum. This, of course, limits the throughput of the printer.

Accordingly, there is a need for a pad printing system that provides greater printing throughput. Desirably, such a system provides for an increased number of stations or locations at which ink can be picked up from the cliché.

SUMMARY OF THE INVENTION

A rotating cliché pad printer includes a frame, a flat cliché operably mounted to the frame having at least one etched region and adapted to receive ink in the etched region and an ink cup configured to reside on the cliché and to deposit ink into the at least one etched region. The cliché and ink cup are rotatably movable relative to one another. In a present printer, the cliché is stationary and the ink cup rotates around the cliché. A pad applicator includes at least one pad adapted to reciprocate to move into and out of contact with the etched region to receive ink from the cliché plate etched region. The pad applicator is also configured to rotate so as to reciprocate to move the pad into and out of contact with an associated object to transfer the received ink to the object.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
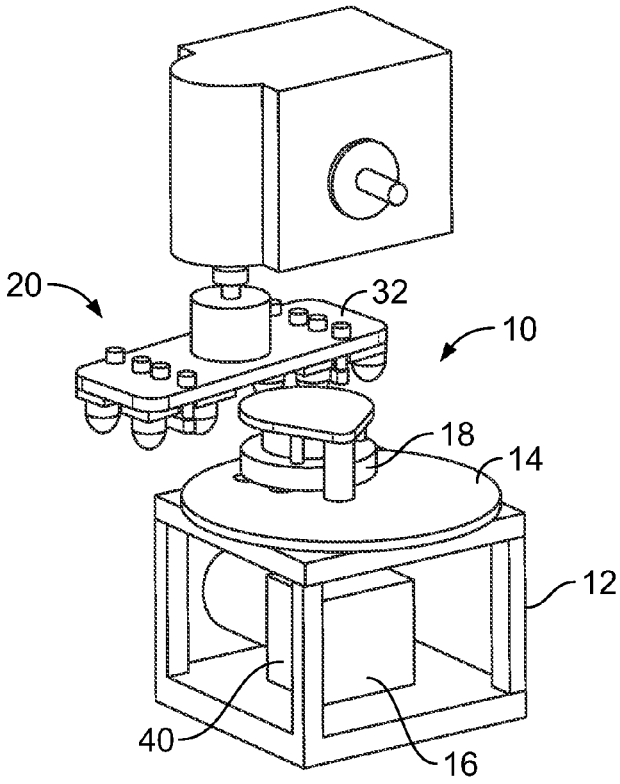
FIG. 1 is an illustration of an embodiment of a rotating cliché pad printer embodying the principles of the present invention, the printer being shown with the ink cup moving over the cliché plate etchings.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Figure 4:
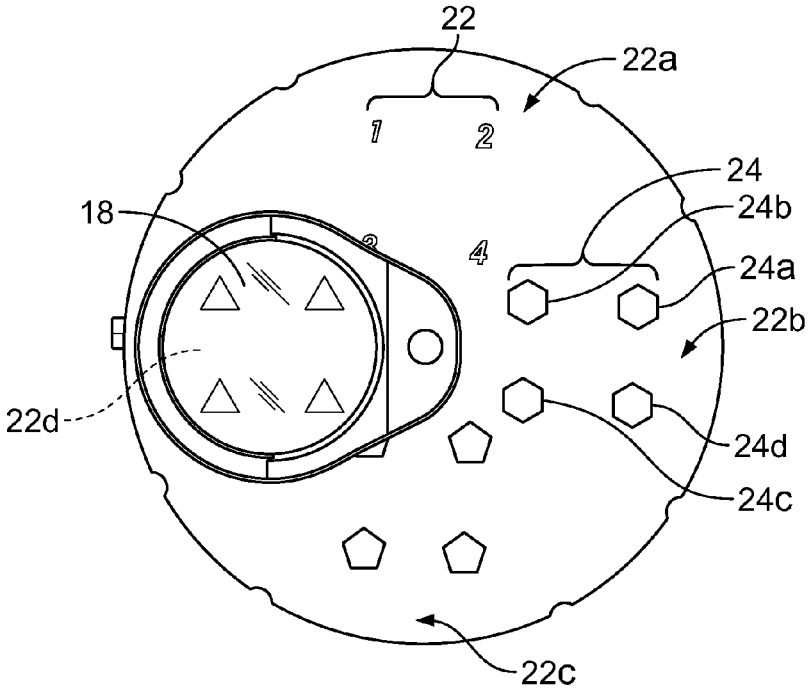
FIG. 4 is a plan view of an embodiment of the cliché plate showing four sets of etchings (each set having four individual etchings)

Referring now to the figures and briefly to FIG. 1 there is shown a rotating cliché pad printing system 10. The illustrated system includes a frame 12 having a cliché plate 14, an ink supply system 16 including an ink cup 18, and a pad applicator system 20. Referring briefly to FIG. 4, the illustrated plate is circular and includes multiple locations 22 having etched regions therein. The plate can include more than one set of etchings, such as the four sets of etchings 22*a-d* illustrated. Within each region there can be multiple etchings 24*a-d* that represent the desired printing to be transferred. It will be appreciated that multiple etchings or a single etching can be present in each region.

Figure 2:
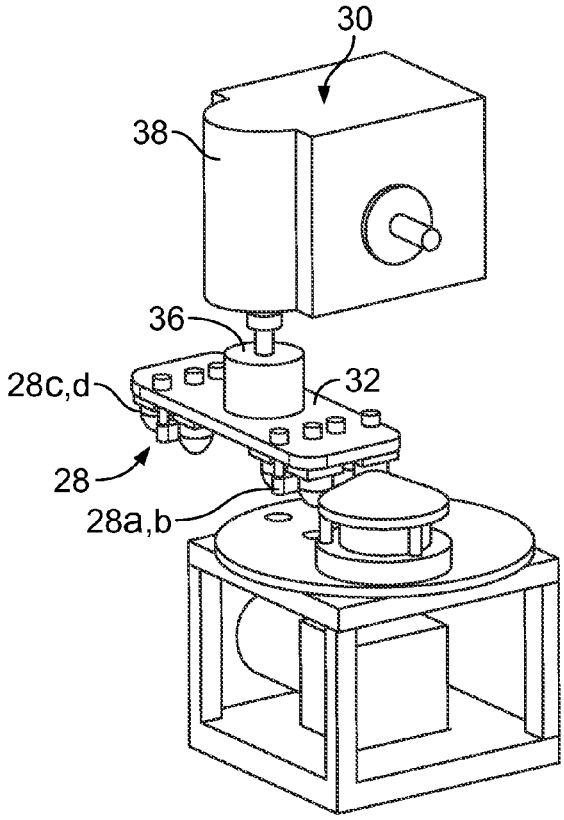
FIG. 2 is an illustration of the printer of FIG. 1 with the ink cup rotated away from the etchings and the printing pads positioned over the inked etchings.
Figure 3:
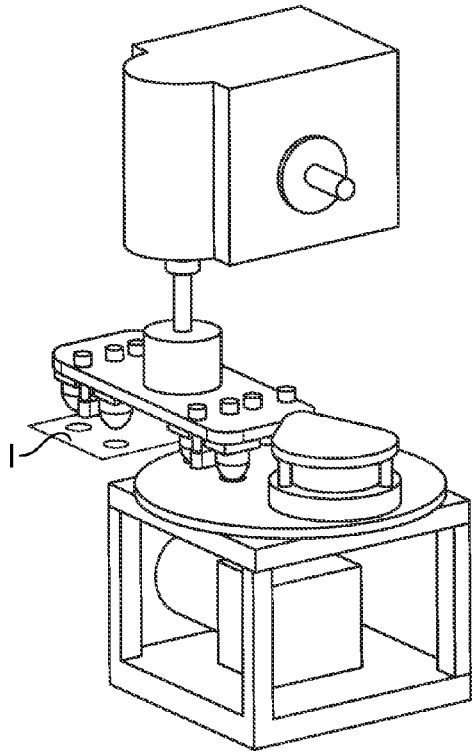
FIG. 3 is an illustration of the printer of FIGS. 1 and 2 with the printing pads moved into contact with the cliché plate etchings.

Referring to FIG. 2, the ink supply system includes an ink cup having a doctor blade 26. The ink cup moves relative to the cliché plate to deposit ink in each of the etched regions and the doctor blade removes or wipes excess ink from the etched region and assure even deposit of ink in the etchings. The ink supply system can be gravity fed or pump fed with or without a recovery system, as will be appreciated by those skilled in the art.

In the present embodiment, the cliché plate is stationary and the ink cup is configured to rotate about the plate. As set forth above, the cliché plate has multiple regions with etched areas and as the ink cup rotates about the plate, ink is deposited in the area. One or more pads 28 are mounted to a pad assembly 30. The pad drive assembly moves the pad or pads into contact with the inked cliché plate and then into contact with the item or items to be printed.

In the illustrated embodiment, four pads 28*a-d* are present on a rigid support member 32, distributed two to a "side" 34 of the support member. The pad drive assembly has a reciprocating drive 36 and a rotational drive 38. The reciprocating drive moves the pads at a first radial position in a vertical motion into and out of contact with the cliché plate (to transfer ink in the form of an image onto the pad) and at a second radial position moves that same pad or pads in a vertical motion into and out of contact with the item to be printed (to transfer the image from the pad to the item). It is the same reciprocating motion, e.g., a single vertical motion, in this case, up and down, that effects both transfer from the cliché to the pad and transfer from the pad to the item.

The pad rotational drive moves a pad from the first radial position to the second radial position and from the second radial position to the first radial position. In other words, the rotational drive rotates the pads (between radial positions)

from over the cliché plate to over the items to be printed. In the first radial position, when the reciprocating drive is actuated, a first set of pads 28*a,b* is moved into contact with the cliché plate and a second set of pads 28*c,d* (on an opposite side of the support member) is moved into contact with the item or items to be printed. The reciprocating drive is then actuated in an opposite direction such that the sets of pads are retracted from the cliché plate and the items onto which print was transferred, respectively.

The rotating drive is then actuated and the first set of pads is positioned over the items to be printed and the second set of pads is positioned over the cliché plate. The reciprocating drive is then actuated to move the second set of pads into contact with the items to be printed and the first set of pads into contact with the cliché plate.

It will be appreciated by those skilled in the art that the present rotating cliché pad printer in essence, provides multiple stations on a single cliché plate at which a printing pad can be "inked" to effect an increase in printing throughput. Accordingly, although the printer described herein uses a round stationary cliché plate with rotating ink cup, the same relative movement between the cliché plate and the ink cup can be effected by a rotating cliché plate and stationary ink cup(s). It will also be appreciated that although four "sets" of etchings are shown (in FIG. 4) and described relative to the round cliché plate, any shape plate have any number of sets of etchings (and etchings within each set) can be used, as practical, as can more than one pad drive assembly and station.

Figure 5:
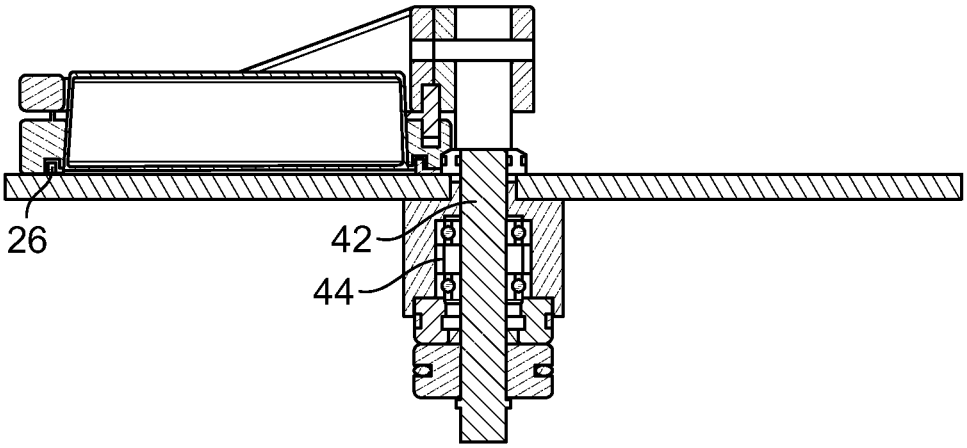
FIG. 5 is a cross-section of the cliché plate and ink cup.

In order to drive the ink cup(s) (or cliché plate), the printer includes a motor, such as a servomotor to precisely control the position of the motor output (shaft). As seen in FIG. 5, an output shaft 42 mounted by multiple bearings 44 and the like can be used to drive the cup and to assure smooth, precise rotational movement of the cup. One servomotor can serve to drive the ink cup(s) (or cliché plate) and another servo can be used for the printing pad rotational drive 38. The vertical movement of the pad drive can be by cylinder, motor or other drive. Likewise, the rotational drives can also be other suitable type drives, which other drives will be recognized and appreciated by those skilled in the art.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A rotating cliché pad printer comprising:

a frame;

a flat cliché plate operably mounted to the frame, the flat cliché plate including at least two etched regions adapted to receive ink thereon, the flat cliché plate being stationary during a printing process;

an ink cup configured to reside on the flat cliché plate and to deposit ink into each of the at least-two etched regions, the ink cup being rotatable in a circular path about an axis extending through the flat cliché plate; and a pad applicator including at least two pads each corresponding to one of the at least two etched regions on the flat cliché plate, the pads being adapted to rotate and to reciprocate, to simultaneously move into and out of contact with the corresponding etched regions and to simultaneously contact an associated object, wherein the reciprocating movement being vertical, into and out of contact with flat cliché plate at a first inking position and into and out of contact with the object to which the ink is transferred at a second printing position, the rotational movement being between the first inking position and the second printing position.

2. The rotating cliché pad printer of claim 1 wherein the flat cliché plate is stationary and the ink cup rotates along the cliché plate.

3. The rotating cliché pad printer in accordance with claim 1 wherein the flat cliché plate includes four etched regions.

4. The rotating cliché pad printer in accordance with claim 1 wherein each of the at least two etched regions includes multiple etchings.

* * * * *